United States Patent [19]

Demetriades

[11] Patent Number: 4,577,364

[45] Date of Patent: Mar. 25, 1986

[54] FLOOR CLEANING MACHINE

[76] Inventor: Peter G. Demetriades, P.O. Box 1790, Henderson, N.C. 27536

[21] Appl. No.: 628,568

[22] Filed: Jul. 6, 1984

[51] Int. Cl.[4] ..... A47L 11/282; A47L 11/30

[52] U.S. Cl. ..... 15/320; 15/98; 15/230.14; 15/230.17; 15/383

[58] Field of Search ..... 15/98, 230, 230.12, 15/230.14, 230.17, 320, 366, 384, 103.5, 321

[56] References Cited

U.S. PATENT DOCUMENTS

| | | | |
|---|---|---|---|
| 2,001,099 | 5/1935 | Holt | 51/176 |
| 2,211,716 | 8/1940 | Fallon | 15/93 |
| 2,291,524 | 7/1942 | Best | 15/230.17 |
| 2,407,408 | 9/1946 | Erickson | 15/320 |
| 2,532,248 | 11/1950 | Upper | 15/230.12 |
| 2,910,720 | 11/1959 | Smith | 15/320 |
| 3,550,181 | 12/1970 | Dolan | 15/320 |
| 3,654,656 | 4/1972 | Romagosa | 15/24 |
| 4,159,555 | 7/1979 | Schneider | 15/320 X |
| 4,167,799 | 9/1979 | Webb | 15/320 |
| 4,360,946 | 11/1982 | Marshall, Jr. | 15/321 |

*Primary Examiner*—Chris K. Moore

*Attorney, Agent, or Firm*—Lalos, Keegan & Kaye

[57] ABSTRACT

A floor cleaning machine including a support frame with a handle attached to the upper end of the support frame for guiding the machine along the floor and a wheel assembly attached to the lower end. A plurality of disc-shaped floor cleaning pads disposed and held adjacent one another such that a floor pad cylinder having a horizontally-disposed longitudinal axis is formed are attached to the lower end of the frame. A motor supported by the frame rotates the floor pads about the axis on the floor in a vertical cleaning motion. A spraying system sprays cleaning fluid downward towards the floor and forward of the rotating cleaning pads. The dirtied cleaning fluid is then sucked up through a nozzle positioned behind the floor pad cylinder to a vacuum and holding tank assembly mounted on the frame.

20 Claims, 4 Drawing Figures

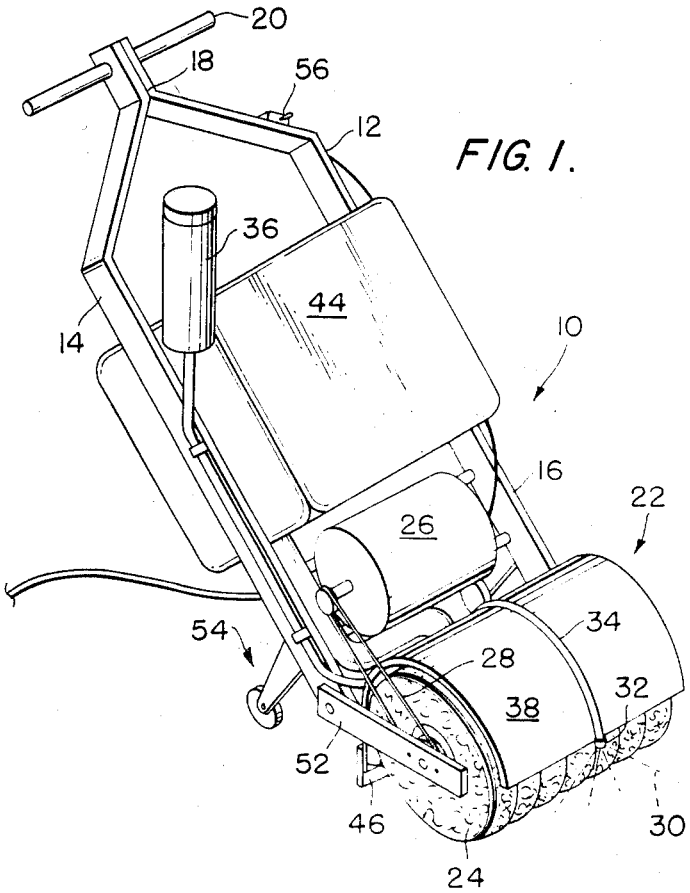
FIG. 1.
FIG. 3.
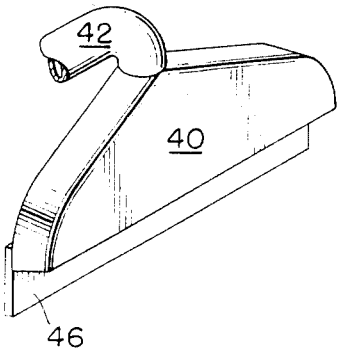
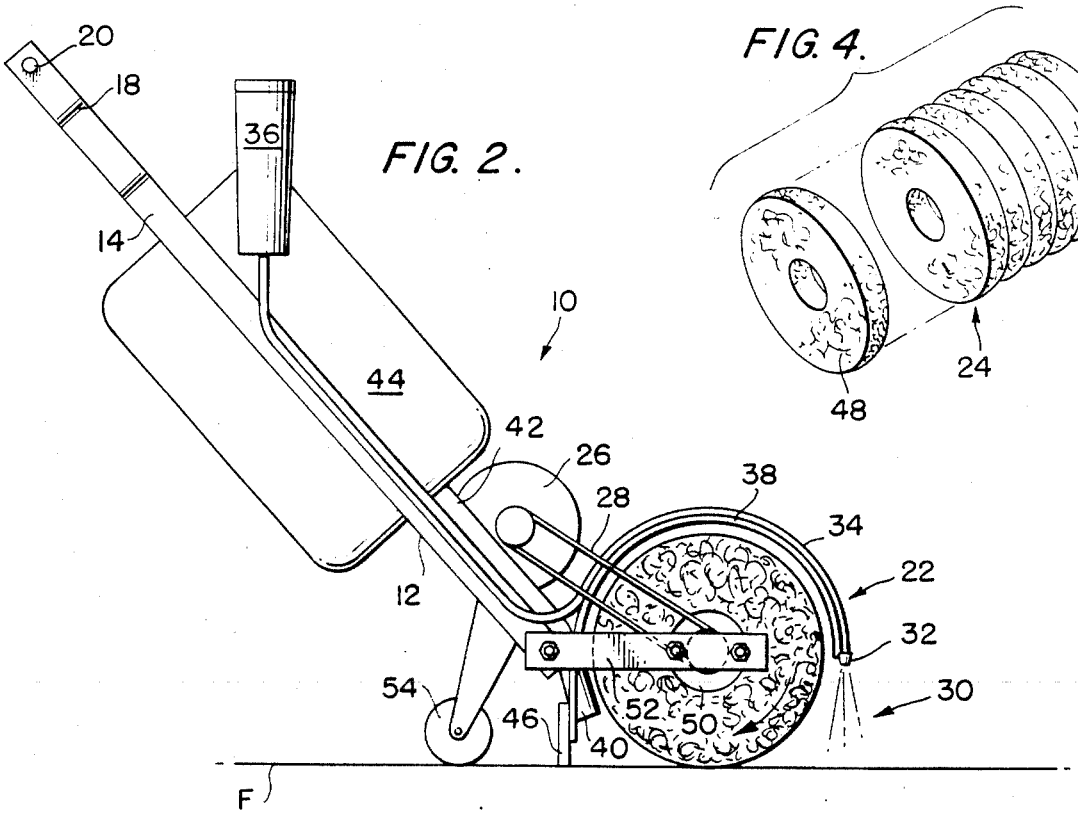
FIG. 2.
FIG. 4.
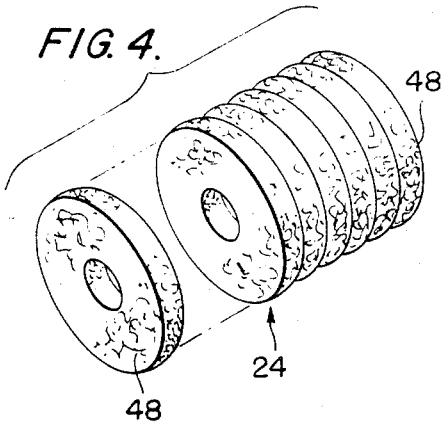

FLOOR CLEANING MACHINE

BACKGROUND OF THE INVENTION

The present invention relates to floor cleaning machines and also to the floor cleaning pad assemblies for the machines.

In the past it has been known to position the floor cleaning machine on top of the cleaning pad and then to rotate the pad on the floor about a vertical axis. However, this design requires a great deal of motive power. Additionally, due to the swirling action of the pad across the floor the floor cleaning machines in the past have not been very maneuverable. Further, the prior art floor cleaning machines would swirl the dirtied cleaning fluid radially out from the entire circumference of the pad thereby making subsequent collection of the dirtied fluid difficult.

OBJECTS OF THE INVENTION

Accordingly, it is the principal object of the present invention to provide a novel design for a floor cleaning machine and a cleaning pad assembly therefor.

Another object is to provide an improved floor cleaning machine.

A further object of the present invention is to provide an improved floor cleaning machine which requires less power to operate.

A still further object of the present invention is to provide a floor cleaning machine that is more maneuverable.

Another object of the present invention is to provide a floor cleaning machine which can operate with higher speeds and with lower RPMs.

A further object is to provide a floor cleaning machine which is more nearly self-propelled.

A still further object is to provide a novel cleaning machine which eliminates the swirling-about-the-floor action present in prior art machines.

Other objects and advantages of the present invention will become more apparent to those persons having ordinary skill in the art to which the present invention pertains from the foregoing description taken in conjunction with the accompanying drawings.

DESCRIPTION OF THE DRAWINGS

FIG. 1 is a perspective view of a floor cleaning machine embodying the present invention.

FIG. 2 is a side elevational view of the floor cleaning machine of FIG. 1.

FIG. 3 is an enlarged perspective view illustrating in isolation the vacuum nozzle of the machine of FIG. 1.

FIG. 4 is a perspective view of the cleaning pads of the machine of FIG. 1 illustrated in isolation and in exploded relation.

DESCRIPTION OF THE PREFERRED EMBODIMENT

Referring to FIG. 1, a floor cleaning machine is illustrated generally at 10 for cleaning floor F. Floor cleaning machine 10 includes a support frame 12 having parallel spaced side members 14, 16 joined at their upper ends 18, where a handle 20 for guiding machine 10 along the floor is attached. Machine 10 includes a novel cleaning pad assembly shown generally at 22 mounted at the lower end of support frame 12. Cleaning pad assembly 22 includes a cylindrical cleaning pad 24 rotatable about a horizontal axis. A motor 26 mounted between side members 14, 16, through a drive belt 28, rotates cylindrical cleaning or polishing pad 24 about the horizontal axis. Belt 28 is shown in FIGS. 1 and 2 positioned to one side of cylindrical cleaning pad 24 but it is also within the scope of the present invention to have it positioned in the middle of the length of the cylindrical cleaning pad 24.

A cleaning "stripper" fluid 30, which consists of a stripper, or a soap is sprayed downward and forward of the cylindrical cleaning pad out through a spray nozzle 32 which is connected by hose 34 to a spray solution container 36 secured to an upper portion of side member 14. Cylindrical cleaning pad 24, acting in a vertical scrubbing motion, scrubs stripper fluid solution 30 on the floor F, as shown by the arrow in FIG. 2. A curved shield 38 is positioned over, and spaced slightly above cylindrical cleaning pad 24, and keeps the dirtied fluid from being kicked upwards to the motor and to the machine operator. The dirtied fluid is then kicked upwards and backwards by the rotating cylindrical cleaning pad 24 to the elongated suction nozzle 40 shown in FIG. 2 and best shown in isolation in FIG. 3. Elongated suction nozzle 40 is connected through hosing 42 to the vacuum and holding tank assembly 44 mounted to and between frame side members 14, 16. A squeegee 46 is secured to the lower end of nozzle 40, or alternatively to shield 38, and is positioned to wipe the floor F as the cleaning machine 10 is run along the floor and so that nozzle 40 can then suck the excess fluid from squeegee 46 into the vacuum and holding tank 44. Since the present machine recovers more of the fluid than previously possible, the machine can be adapted to include a recycling system (not shown) which takes the dirtied fluid from the holding tank, filters it and returns it to the spray solution container, providing a nearly self-sufficient cleaning fluid system.

Fluid 30 can also be a cleaning and polishing fluid consisting of a polymer wax or any other of the many polishing liquids including water, and sprayed in a similar manner through spray nozzle 32 forward of pad 24. Cylindrical polishing pad 24, acting in a vertical motion, thereby buffs and polishes the floor F, and curved shield 38 keeps the dust and other debris from being kicked upwards to the motor and machine operator. If not needed to direct the flow of dirt, squeegee 46 can be raised or removed from nozzle 40 or shield 38. Alternatively, the machine may be used for dry polishing without the use of the spray solution.

Cleaning or polishing pad cylinder 24 is comprised of a series of disc-like floor pads 48 mounted adjacent to each other to define a cylinder, as best shown in FIG. 4. Alternatively, a single elongated cleaning pad cylinder can be used. Each disc is one-half to one inch in thickness and seven to fourteen inches in diameter. A pair of metal pronged discs 50 are attached at the centers of the opposite end pads 48 with their prongs projecting inwardly into the pads thereby holding the pads together. Drive belt 28 is then operatively connected to one of the metal discs. Each of pads 48 is made from natural or synthetic fibers, woven or non woven, with thermoplastic binders or resins and formed by an air layering system. The binders or resins provide a sticky surface and when pads 48 are placed adjacent each other they adhere to one another. If necessary, to hold them together, a cylindrical rod (not shown) can be placed through openings in the pads thereby holding the pads together. The entire pad assembly 22 is secured to the forward end of frame 12 by brackets 52 bolted to the lower end of the frame 12 and extending out from it. A support wheel assembly 54 is mounted rearward of brackets 52 to frame 12.

In the past, polishers with propane fuel could operate at 2500 RPM, electric polishers at 5000 RPM but the present floor cleaning machine operates at 3000 RPM. It is anticipated that a one half horsepower AC motor 26 would be used to rotate the cleaning pads but it is also within the scope of the present invention to use a DC or variable speed motor. A suitable on-off control switch 56 mounted to the upper end of the frame near handle 20 is easily accessible to the operator for controlling motor 26.

From the foregoing detailed description, it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A floor cleaning machine comprising:

a frame having a frame lower end and a frame upper end, a handle attached to said frame upper end, a wheel assembly attached to said frame for supporting, at least in part, said frame on a floor, a plurality of disc-shaped floor cleaning pads, each having an outer edge adapted to clean the floor, a holding means for holding said floor cleaning pads longitudinally adjacent one another such that a floor pad cylinder having a longitudinal axis is formed and such that said longitudinal axis is horizontally disposed, said outer edges together forming the circumferential floor cleaning surface of said floor pad cylinder, a motor supported by said frame for rotating said floor cleaning pads about said horizontal longitudinal axis, said holding means holding said floor cleaning pads so that said outer edges, when said motor rotates said floor cleaning pads, engage the floor in a vertical cleaning motion, a spraying means supported by said frame for spraying cleaning fluid towards the floor and generally forward of said floor cleaning pads, a fluid pick-up means supported by said frame for recovering cleaning fluid from the floor after said floor cleaning pads have been rotated on the floor by said motor, and said fluid pick-up means including a wiping member engageable with the floor, a holding tank supported by said frame for holding the excess fluid recovered from the floor, and a suction means generally adjacent to said wiping member for sucking excess fluid to said holding tank.

2. The floor cleaning machine of claim 1 including, a cleaning fluid storage container supported by said frame for supplying fluid to said spraying means.

3. The floor cleaning machine of claim 1 including, said wiping member comprising a squeegee positioned to be in contact with the floor.

4. The floor cleaning machine of claim 1 including, said frame including spaced first and second frame members extending from said handle downward to said lower frame end, and said motor and said holding tank being positioned between said first and second frame members.

5. The floor cleaning machine of claim 4 including, said holding tank being positioned above said motor.

6. The floor cleaning machine of claim 1 including, said cleaning pads having a horizontal pad assembly drive axis, said motor having a horizontally extending motor drive shaft parallel to said pad assembly drive axis, and a drive belt directly and drivingly connecting said motor drive shaft to said pad assembly drive shaft.

7. The floor cleaning machine of claim 1 including, an arcuate shield positioned directly above and over the upper half of said cleaning pads, and said spraying means being attached to said shield.

8. The floor cleaning machine of claim 1 including, each said cleaning pad being made from fibers embedded in a resin.

9. The floor cleaning machine of claim 1 including, said holding means including a pair of opposed metal discs positioned at the outer ends of said cylinder and having prongs projecting into the outermost said cleaning pads.

10. The floor cleaning machine of claim 1 including, said motor being an electric motor operating at 3000 RPM.

11. The floor cleaning machine of claim 1 including, said cleaning fluid comprising a fluid wax and a floor wax stripper fluid mixture.

12. The floor cleaning machine of claim 1 including, said horizontal axis being spaced forward of said frame lower end.

13. The floor cleaning machine of claim 1 including, said wheel assembly being attached to said frame behind the attachment point of said mounting means to said frame lower end.

14. The floor cleaning machine of claim 1 including, said disc-shaped floor cleaning pads being formed of a non-woven abrasive material.

15. The floor cleaning machine of claim 1 including, said suction means including a nozzle having an elongated horizontal opening positioned behind and parallel to said floor pads and hosing connecting said nozzle and said holding tank.

16. The floor cleaning machine of claim 1 including, said disc-shaped floor cleaning pads being formed from randomly-distributed, air-layered fibers in a binder.

17. The floor cleaning machine of claim 1 including, said disc-shaped pads being one-half to one inch thick and 12–14 inches in diameter, and said holding means holding between five and nine said disc-shaped floor cleaning pads in adjacent relation.

18. The floor cleaning machine of claim 1 including, said holding means including said disc-shaped floor cleaning pads being formed of a sticky material that causes the surfaces of adjacent disc-shaped floor pads to adhere to each other.

19. The floor cleaning machine of claim 1 including, said holding means including a pair of horizontally opposed discs positioned at opposite ends of said floor pad cylinder and having prongs projecting horizontally inwardly into the end of said floor pads.

20. The floor cleaning machine of claim 1 including, said floor pad cylinder having a longitudinal axis greater than its radius.

* * * * *